US010152854B2

(12) United States Patent
Tsukamoto et al.

(10) Patent No.: US 10,152,854 B2
(45) Date of Patent: Dec. 11, 2018

(54) WIRELESS DEVICE, MANAGEMENT DEVICE, AND GUIDE SYSTEM FOR EVACUATION ROUTE GUIDANCE

(71) Applicant: JVC KENWOOD Corporation, Yokohama-shi, Kanagawa (JP)

(72) Inventors: Kazuya Tsukamoto, Yokohama (JP); Ichiro Shishido, Yokohama (JP); Shunichi Manabe, Yokohama (JP); Masae Toko, Yokohama (JP); Tomoko Yaginuma, Yokohama (JP); Yoshihiro Hotta, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 109 days.

(21) Appl. No.: 15/098,619

(22) Filed: Apr. 14, 2016

(65) Prior Publication Data

US 2016/0321883 A1 Nov. 3, 2016

(30) Foreign Application Priority Data

Apr. 28, 2015 (JP) ..... 2015-091014

(51) Int. Cl.
*G08B 7/06* (2006.01)

(52) U.S. Cl.
CPC ..... *G08B 7/066* (2013.01)

(58) Field of Classification Search
CPC ..... G08B 7/066; G08B 17/10; G08B 25/016; G08B 27/001; G08B 23/00; G08B 25/005; G08B 25/009; G08B 25/014; G08B 27/00; G08B 7/062; G01C 21/34; H04W 4/22; A62B 3/00; H04H 20/59
See application file for complete search history.

(56) References Cited

U.S. PATENT DOCUMENTS

2007/0096931 A1* 5/2007 Runciman ..... G08B 1/08 340/628
2008/0004790 A1* 1/2008 Ames ..... G01C 21/3461 701/117
2009/0038891 A1* 2/2009 Kawai ..... B66B 5/021 187/247
2013/0036175 A1* 2/2013 Lau ..... G08B 27/001 709/206
2015/0279184 A1* 10/2015 Kore ..... G08B 7/066 340/539.13

FOREIGN PATENT DOCUMENTS

JP 2014-142758 A 8/2014

* cited by examiner

*Primary Examiner* — Brian Zimmerman
*Assistant Examiner* — Kevin Lau
(74) *Attorney, Agent, or Firm* — Brundidge & Stanger, P.C.

(57) ABSTRACT

A wireless device is possessed by a user. A reporting unit reports, to a management device, status information regarding the surrounding environment of the wireless device and position information of the wireless device. A requesting unit requests the management device to perform guidance to an evacuation route. An accepting unit accepts an instruction for guidance to an evacuation route from the management device when the requesting unit does not request guidance. A notification unit performs notification of an evacuation route.

17 Claims, 19 Drawing Sheets

FIG.8

| STATUS INFORMATION (300) | IDENTIFICATION INFORMATION (302) |
|---|---|
| SAFE | 1 |
| POOR VISIBILITY DUE TO DUST | 2 |
| FILLED WITH SMOKE | 3 |
| FIRE SPREADING | 4 |
| COLLAPSE OF CEILING OR WALL | 5 |

26

FIG.10

310 312

| IDENTIFICATION INFORMATION | SCORE |
|---|---|
| 1 | 1 |
| 2 | 2 |
| 3 | 3 |
| 4 | 20 |
| 5 | 20 |

62

10

WIRELESS DEVICE, MANAGEMENT DEVICE, AND GUIDE SYSTEM FOR EVACUATION ROUTE GUIDANCE

CROSS-REFERENCE TO RELATED APPLICATION

This application is based upon and claims the benefit of priority from the prior Japanese Patent Application No. 2015-91014, filed on Apr. 28, 2015, the entire contents of which are incorporated herein by reference.

BACKGROUND

1. Field

The present invention relates to a guiding technique, and particularly to a wireless device, a management device, and a guide system used for guidance to an evacuation route.

2. Description of the Related Art

In order to enable a person to be evacuated in a building to intuitively find a direction to evacuate, multiple indoor position information transmitters may be placed in the building, and each of the indoor position information transmitters transmits indoor position information. A portable terminal then receives the indoor position information and also receives evacuation route information indicating an evacuation route. Based on the information, the portable terminal displays a guiding direction on a display (see Patent Document 1, for example).

[Patent Document 1] Japanese Patent Application Laid-open No. 2014-142758

Placing multiple indoor position information transmitters in advance within various buildings is not practical. In a building where multiple indoor position information transmitters are not placed in advance, guidance to an evacuation route will be impossible. Accordingly, guidance to an evacuation route should be desirably provided while increase in facilities is prevented.

SUMMARY

To solve the problem above, an aspect of the present embodiment relates to a wireless device possessed by a user, and the wireless device comprises: a reporting unit that reports, to a management device, status information regarding the surrounding environment of the wireless device and position information of the wireless device; a requesting unit that requests the management device to perform guidance to an evacuation route; and an accepting unit that accepts an instruction for guidance to an evacuation route from the management device when the requesting unit does not request guidance.

Another aspect of the present embodiment relates to a management device. The device comprises: a first accepting unit that accepts, from each of multiple wireless devices, status information regarding the surrounding environment of the wireless device and position information of the wireless device; a second accepting unit that accepts a request for guidance to an evacuation route from one of multiple wireless devices; a deriving unit that derives, when the second accepting unit accepts a request, an evacuation route on the basis of status information and position information accepted by the first accepting unit; and an instruction unit that instructs a wireless device arranged along an evacuation route derived by the deriving unit to perform guidance to the evacuation route.

Yet another aspect of the present embodiment relates to a guide system. The guide system comprises multiple wireless devices and a management device capable of communicating with each of the multiple wireless devices. The management device comprises: a first accepting unit that accepts, from each of multiple wireless devices, status information regarding the surrounding environment of the wireless device and position information of the wireless device; a second accepting unit that accepts a request for guidance to an evacuation route from one of multiple wireless devices; a deriving unit that derives, when the accepting unit accepts a request, an evacuation route on the basis of status information and position information accepted by the first accepting unit; and an instruction unit that instructs a wireless device arranged along an evacuation route derived by the deriving unit to perform guidance to the evacuation route.

Optional combinations of the aforementioned constituting elements, and implementations of the present embodiment in the form of methods, apparatuses, systems, recording media, and computer programs may also be practiced as additional modes of the present embodiment.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 8 is a diagram that shows a table of status information input via an operation unit shown in FIG. 7;

FIG. 10 is a diagram that shows a table retained in a generating unit shown in FIG. 9;

DETAILED DESCRIPTION

Figure 1:
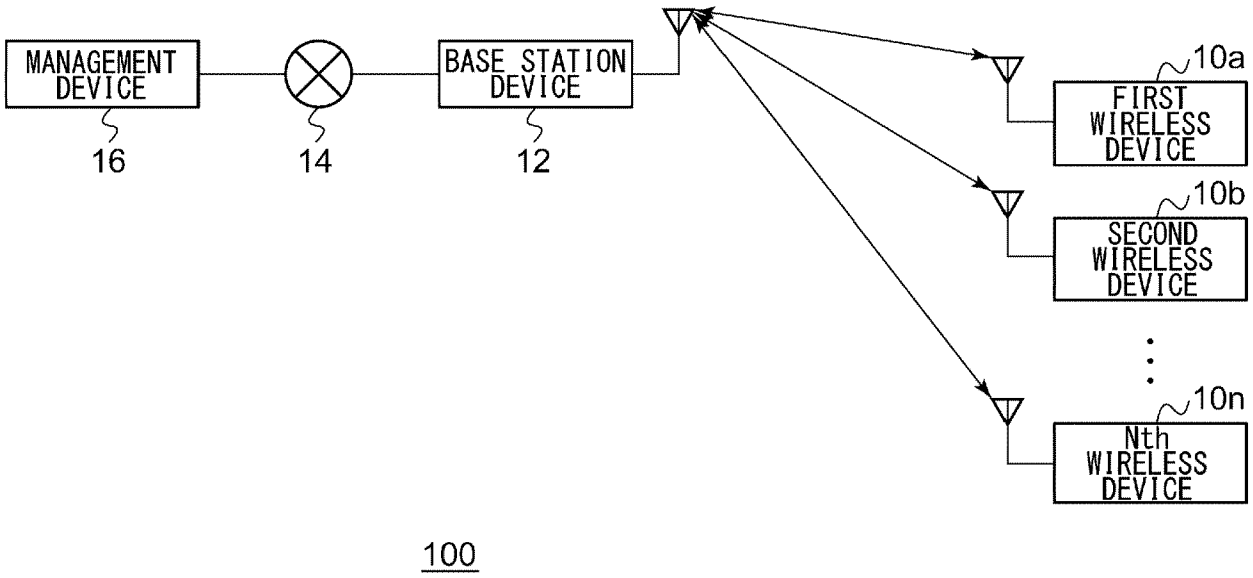
FIG. 1 is a diagram that shows a configuration of a guide system according to a first embodiment.

The invention will now be described by reference to the preferred embodiments. This does not intend to limit the scope of the present invention, but to exemplify the invention.

First Embodiment

A general description will be given before the present invention is specifically described. The first embodiment relates to a guide system that guides a user having a wireless device to an evacuation route. As an example, it is assumed here that the user is a worker, such as a firefighter responsible for disaster relief, and the wireless device is a device available for a wireless communication system, such as a business-use wireless system and a cellular phone system. In such a guide system, a conventional wireless device receives information from multiple indoor position information transmitters placed in advance within a building, as stated previously, and displays an image for guidance superimposed upon an image captured by a camera. Also, a wireless device capable of autonomously measuring a position using an acceleration sensor and a gyro sensor has conventionally displayed position information and an evacuation route on a map.

It is not practical to use the method of placing indoor position information transmitters in advance, in an urgent situation in a building where indoor position information transmitters are not placed. Even in a building where indoor position information transmitters are placed, it is difficult for a user to recognize an actual evacuation route in a short time while viewing information on a small screen of a wireless device. For example, in an emergency including a fire and an earthquake, it is difficult to immediately and accurately recognize the direction from the current position to an exit or the optimum evacuation route based on information displayed on a wireless device. Accordingly, it is desired to enable a user to easily recognize an evacuation route in any place, without the labor and cost of placing a special device.

In the present embodiment, each of multiple wireless devices within a building transmits, to a management device, status information regarding the surrounding environment and position information. The status information indicates "safe," "poor visibility," "fire spreading," and the likes. The management device manages the status information and position information for each of multiple wireless devices. When one of the multiple wireless devices requests guidance to an evacuation route, the wireless device (hereinafter, referred to as a "request-side wireless device") transmits a request signal to the management device. Upon reception of the request signal, the management device derives an evacuation route from the position where the request-side wireless device is located to an exit. The evacuation route is derived from status information and position information so as to include a wireless device other than the request-side wireless device (hereinafter, referred to as a "guide-side wireless device"). For example, two or more guide-side wireless devices are arranged along the direction toward an exit on an evacuation route. The management device then instructs a guide-side wireless device near the request-side wireless device to perform notification.

The guide-side wireless device thus instructed turns on a light emitting diode (LED) or outputs audio from a speaker as a notification. Accordingly, the user having the request-side wireless device moves toward the guide-side wireless device performing the notification. In the meantime, the request-side wireless device continues to periodically transmit position information to the management device. Based on the received position information, the management device perceives that the request-side wireless device is getting closer to the guide-side wireless device instructed to perform notification. When the request-side wireless device reaches the position of the guide-side wireless device instructed to perform notification, the management device instructs the guide-side wireless device to stop the notification and also instructs the next guide-side wireless device included in the evacuation route to perform notification.

The next guide-side wireless device thus instructed turns on an LED or outputs audio from a speaker as a notification. Such a process is repeated until the guide-side wireless device near the exit performs notification. Thus, multiple wireless devices, which normally perform conversation or the like, guide a user to an evacuation route in cooperation with each other in an emergency. Accordingly, the labor and cost of placing a special device is unnecessary. The LED and speaker used for notification of an evacuation route are originally provided in a wireless device. Also, since the management device receives status information and position information from each of multiple wireless devices, an evacuation route suitable for the environment can be set.

FIG. 1 shows a configuration of a guide system 100 according to the first embodiment. The guide system 100 comprises a first wireless device 10*a*, a second wireless device 10*b*, a Nth wireless device 10*n*, which are collectively referred to as wireless devices 10, a base station device 12, a network 14, and a management device 16.

Each of multiple wireless devices 10 is possessed by a worker as a user. The wireless devices 10 are available for a wireless communication system and connected to the base station device 12, which will be described later. As stated previously, a business-use wireless system or a cellular phone system may be used as the wireless communication system, which is a publicly-known technique and a specific description thereof is omitted here. One end of the base station device 12 is available for the same wireless communication system as the wireless devices 10 are and connected to the multiple wireless devices 10. The other end of the base station device 12 is connected to the network 14.

The network 14 is connected to the base station device 12 and also to the management device 16. The network 14 transfers data between various devices. The network 14 may be an arbitrary network, including a wired network, a wireless network, and a combination thereof. With such a configuration, multiple wireless devices 10 can communicate with each other via the base station device 12 and network 14. The communication may be conversation, data communication, or the like.

The management device 16 communicates with each of the multiple wireless devices 10 via the network 14 and the base station device 12. The management device 16 receives status information and position information from each wireless device 10 and manages the information. The management device 16 also receives a request signal from one wireless device 10 among the multiple wireless devices 10. The one wireless device 10 corresponds to the request-side wireless device mentioned previously. Upon reception of the request signal, the management device 16 derives an evacuation route. The management device 16 then transmits a notification instruction to a guide-side wireless device, which is a wireless device 10 included in the evacuation route. Upon reception of the notification instruction, the guide-side wireless device turns on an LED or outputs audio from a speaker as a notification. The guide-side wireless devices perform notification in turn, in the direction from the position of the request-side wireless device to the exit along the evacuation route.

Figure 2:
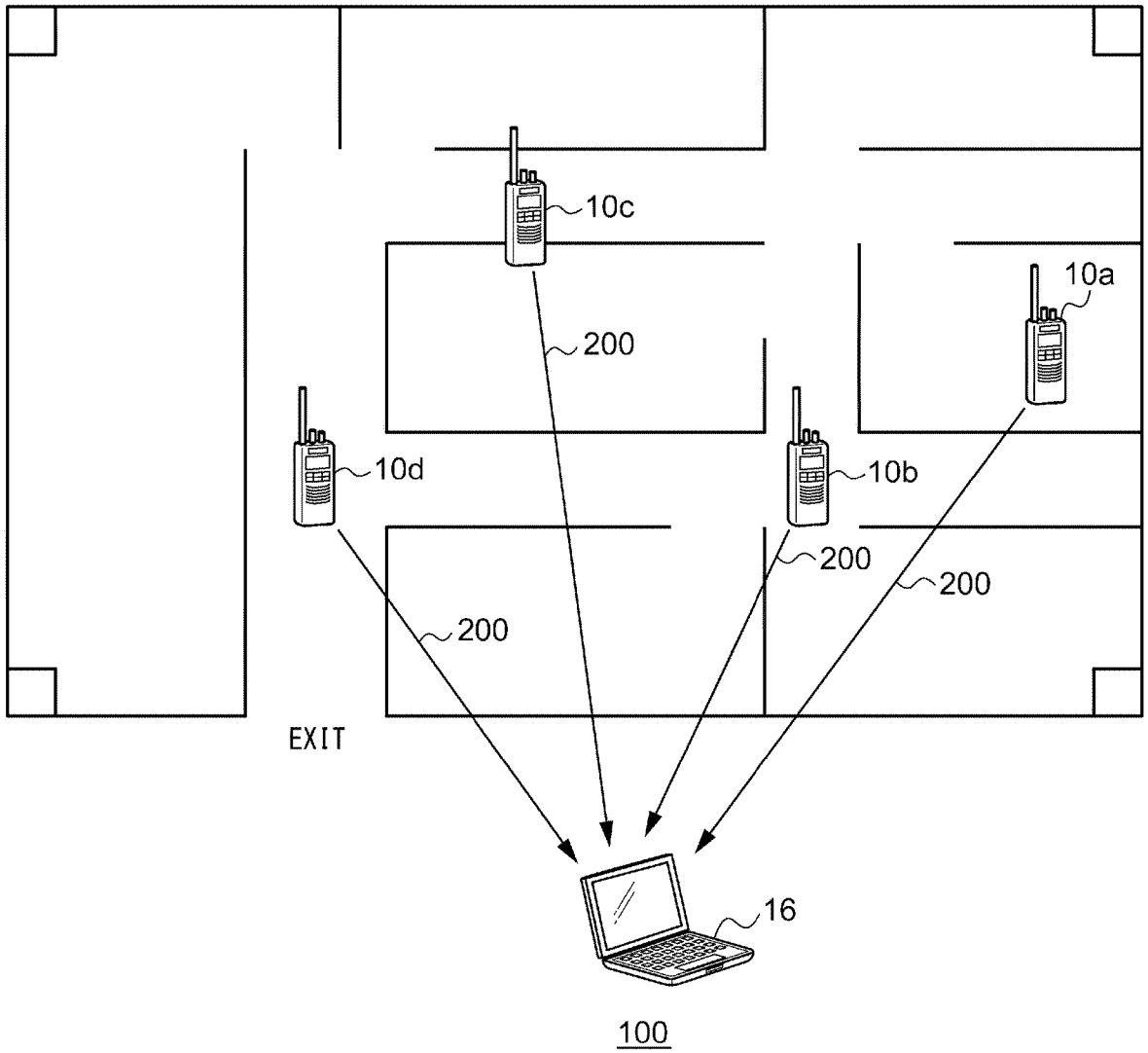
FIG. 2 is a diagram that shows an arrangement of multiple wireless devices in the guide system shown in FIG. 1.

In the following, before the configurations of the wireless devices 10 and management device 16 are described, processing of guidance to an evacuation route performed by the guide system 100 will be specifically described with reference to FIGS. 2-6. FIG. 2 shows an arrangement of multiple wireless devices 10 in the guide system 100. As an example, FIG. 2 shows a plan view of a floor in a building where a fire or another disaster is occurring. As shown in FIG. 2, there are users respectively having the first wireless device 10*a* through the fourth wireless device 10*d* within the building for rescue work. Each of the wireless devices 10 can communicate with the management device 16 via the base station device 12 and network 14, which are not illustrated.

As the status information described previously, the guide system 100 defines, for example, "safe," "poor visibility due to dust," "filled with smoke," "fire spreading," and "collapse of ceiling or wall." The degree of danger of "poor visibility due to dust" is "caution needed," that of "filled with smoke" is "passable with equipment," that of "fire spreading" is "impassable," and that of "collapse of ceiling or wall" is also "impassable." During the user's rescue work, each wireless device 10 transmits status information according to the surrounding environment to the management device 16. The status information according to the surrounding environment may be selected by the user. The status information is transmitted regularly or when information is changed.

Each of the wireless devices 10 also transmits position information to the management device 16. The position information may be transmitted together with the status information or may be transmitted separately from the status information. The position information is also transmitted regularly or when information is changed. In FIG. 2, the status information and position information thus transmitted is collectively shown as status/position information 200. The management device 16 receives the status/position information 200 from each wireless device 10 and stores the status/position information 200 thus received in association with the wireless device 10. Accordingly, the management device 16 understands the place and situation within the building.

Figure 3:
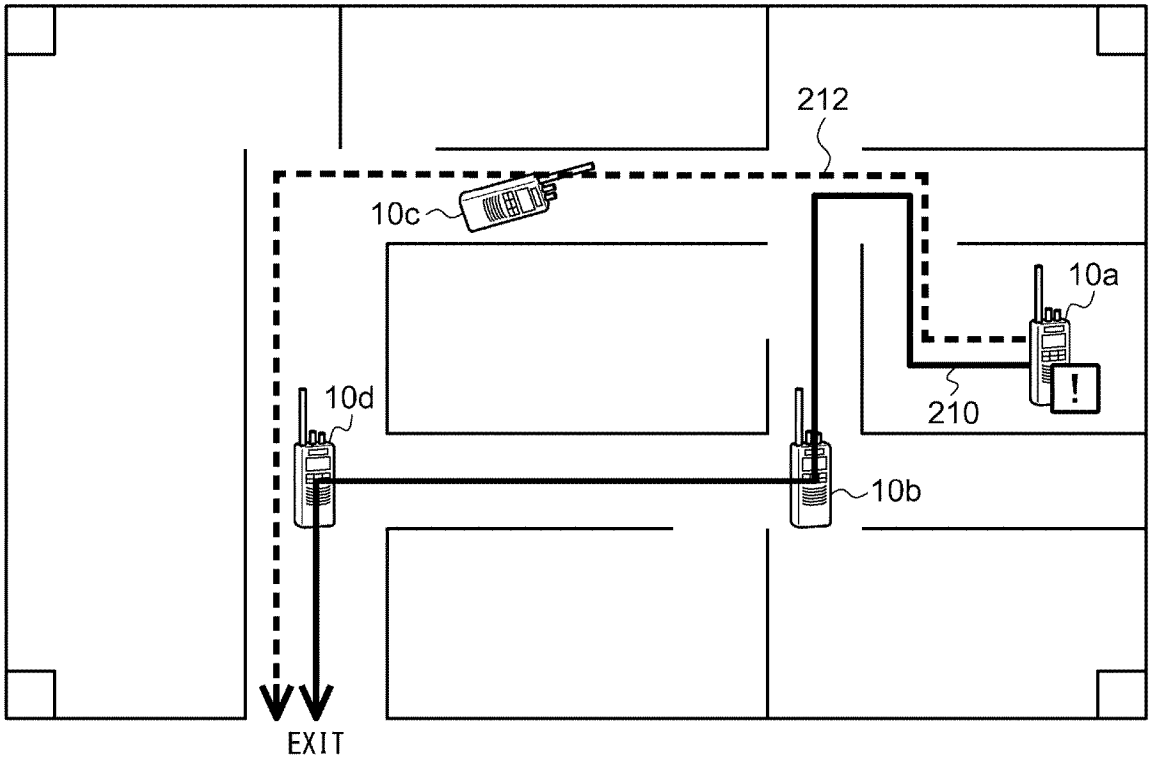
FIG. 3 is a diagram that shows another arrangement of multiple wireless devices in the guide system shown in FIG. 1.

FIG. 3 shows another arrangement of multiple wireless devices 10 in the guide system 100. The arrangement of the first wireless device 10*a* through the fourth wireless device 10*d* is the same as shown in FIG. 2. The first wireless device 10*a* corresponds to the request-side wireless device mentioned previously and transmits a request signal to the management device 16. Upon reception of the request signal from the first wireless device 10*a*, the management device 16 derives an evacuation route from the position where the first wireless device 10*a* is located to the exit. For example, the management device 16 generates a first candidate 210 and a second candidate 212 as evacuation route candidates. The first candidate 210 is a route from the first wireless device 10*a* through the second wireless device 10*b* and the fourth wireless device 10*d* to the exit, and the second candidate 212 is a route from the first wireless device 10*a* through the third wireless device 10*c* and the fourth wireless device 10*d* to the exit. Since the management device 16 recognizes the arrangement of rooms and hallways within the building and also recognizes the position information of each wireless device 10, the management device 16 generates the first candidate 210 and the second candidate 212 based on the recognition. The number of candidates is not limited to "two" and may be a number greater than two.

Based on the status information received from each wireless device 10, the management device 16 selects one of the first candidate 210 and the second candidate 212. For example, it is assumed that the status information from the second wireless device 10*b* is "safe," that from the third wireless device 10*c* is "collapse of ceiling or wall," and that from the fourth wireless device 10*d* is "filled with smoke." In consideration thereof, a path around the second wireless device 10*b* is passable, a path around the third wireless device 10*c* is impassable, and a path around the fourth wireless device 10*d* may be passable depending on the user's equipment. Accordingly, the management device 16 selects the first candidate 210 as the evacuation route. The second wireless device 10*b* and the fourth wireless device 10*d* included in the first candidate 210 correspond to the guide-side wireless devices mentioned previously.

Figure 4:
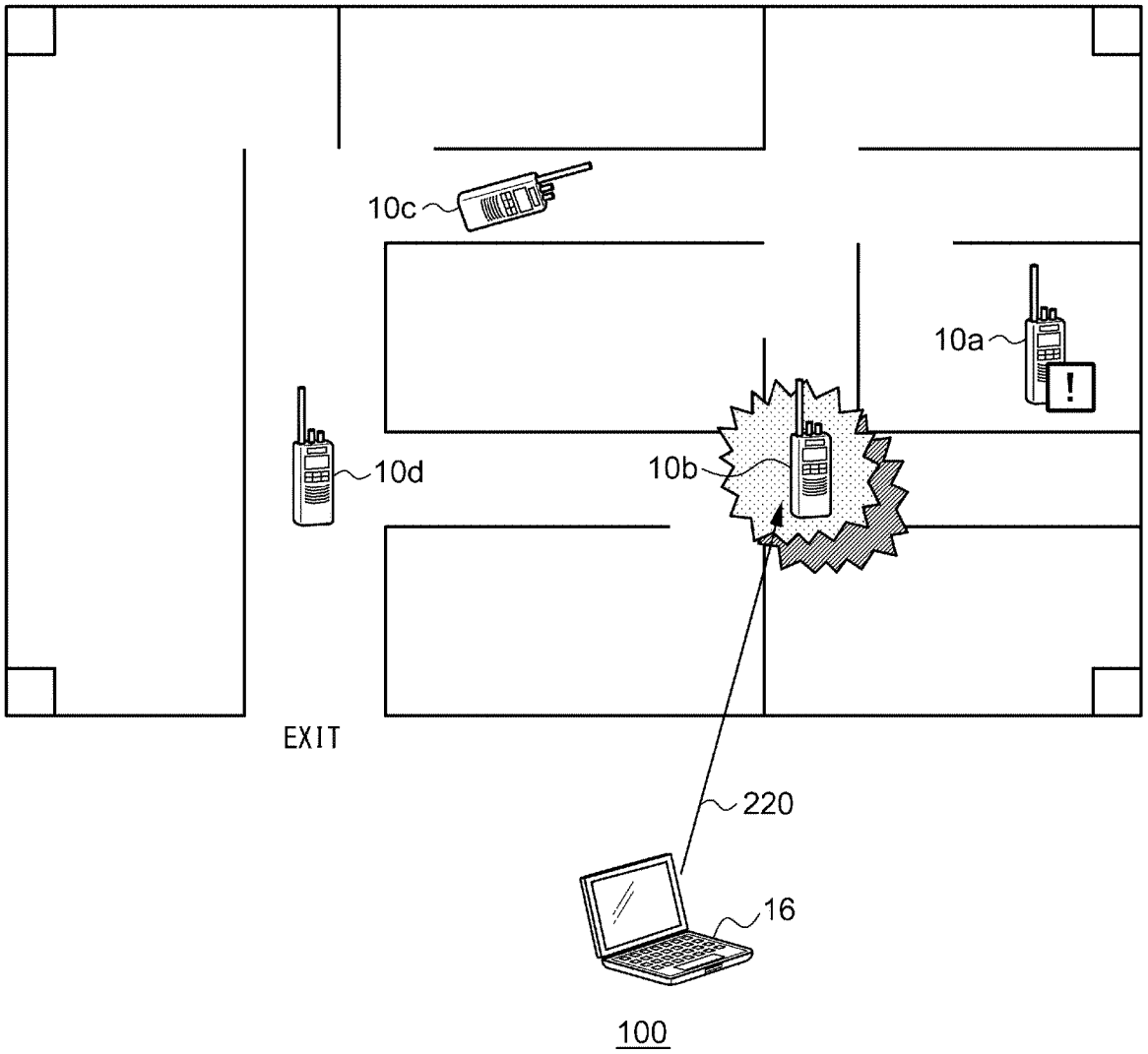
FIG. 4 is a diagram that shows yet another arrangement of multiple wireless devices in the guide system shown in FIG. 1.

FIG. 4 shows yet another arrangement of multiple wireless devices 10 in the guide system 100. Upon deriving the evacuation route, the management device 16 starts guidance to the evacuation route. The management device 16 selects the wireless device 10 closest to the first wireless device 10*a* among the multiple wireless devices 10 arranged on the evacuation route. In this case, the second wireless device 10*b* is selected. The management device 16 then transmits a notification instruction 220 to the second wireless device 10*b* thus selected. Upon reception of the notification instruction 220, the second wireless device 10*b* outputs a beep or turns on an LED to visually or aurally notify a person around the second wireless device 10*b* of the position of the second wireless device 10*b*. According to the sound or light provided by the second wireless device 10*b*, the user having the first wireless device 10*a* recognizes the direction to head in. Based on the recognized direction, the user moves toward the second wireless device 10*b*. In the meantime, the first wireless device 10*a* continues to regularly transmit position information to the management device 16.

Figure 5:
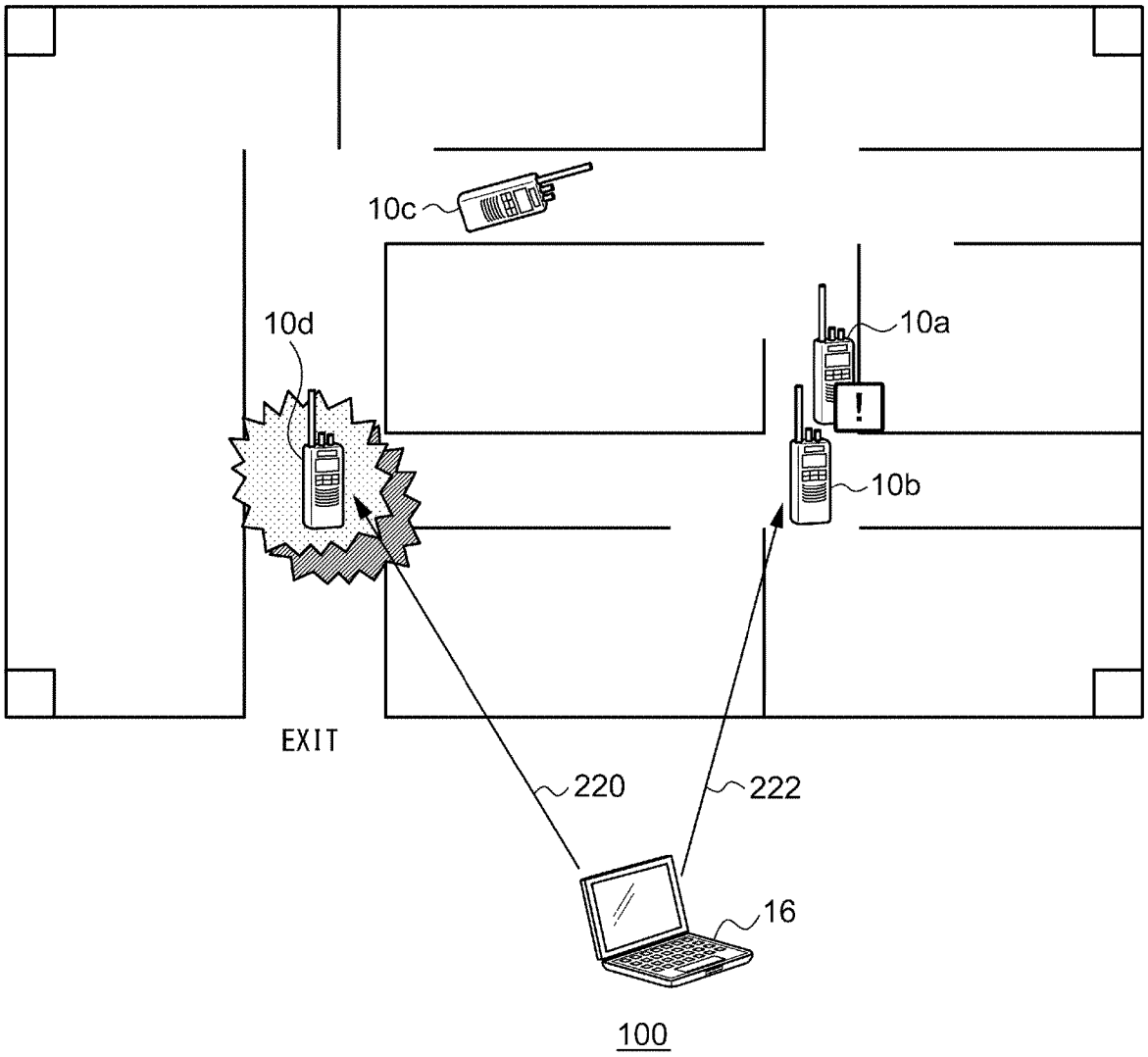
FIG. 5 is a diagram that shows still yet another arrangement of multiple wireless devices in the guide system shown in FIG. 1.

FIG. 5 shows still yet another arrangement of multiple wireless devices 10 in the guide system 100. Based on the position information of the first wireless device 10*a* and the position information of the second wireless device 10*b*, the management device 16 perceives that the first wireless device 10*a* got closer to the second wireless device 10*b*, such as that the first wireless device 10*a* got within one meter of the second wireless device 10*b*. Based on the perception, the management device 16 transmits a stop instruction 222 to the second wireless device 10*b*. Upon reception of the stop instruction 222, the second wireless device 10*b* stops the notification. Thereafter, the management device 16 selects the next wireless device 10 included in the evacuation route. In this case, the fourth wireless device 10*d* is selected.

The management device 16 transmits the notification instruction 220 to the fourth wireless device 10*d* thus selected. Upon reception of the notification instruction 220, the fourth wireless device 10*d* outputs a beep or turns on an LED to visually or aurally notify a person around the fourth wireless device 10*d* of the position of the fourth wireless device 10*d*. According to the sound or light provided by the fourth wireless device 10*d*, the user having the first wireless device 10*a* recognizes the direction to head in. There is no wireless device 10 subsequent to the fourth wireless device 10*d* on this evacuation route; however, if there is a subsequent wireless device 10, the abovementioned processing will be repeated so as to guide the user having the first wireless device 10*a* to the exit.

Figure 6:
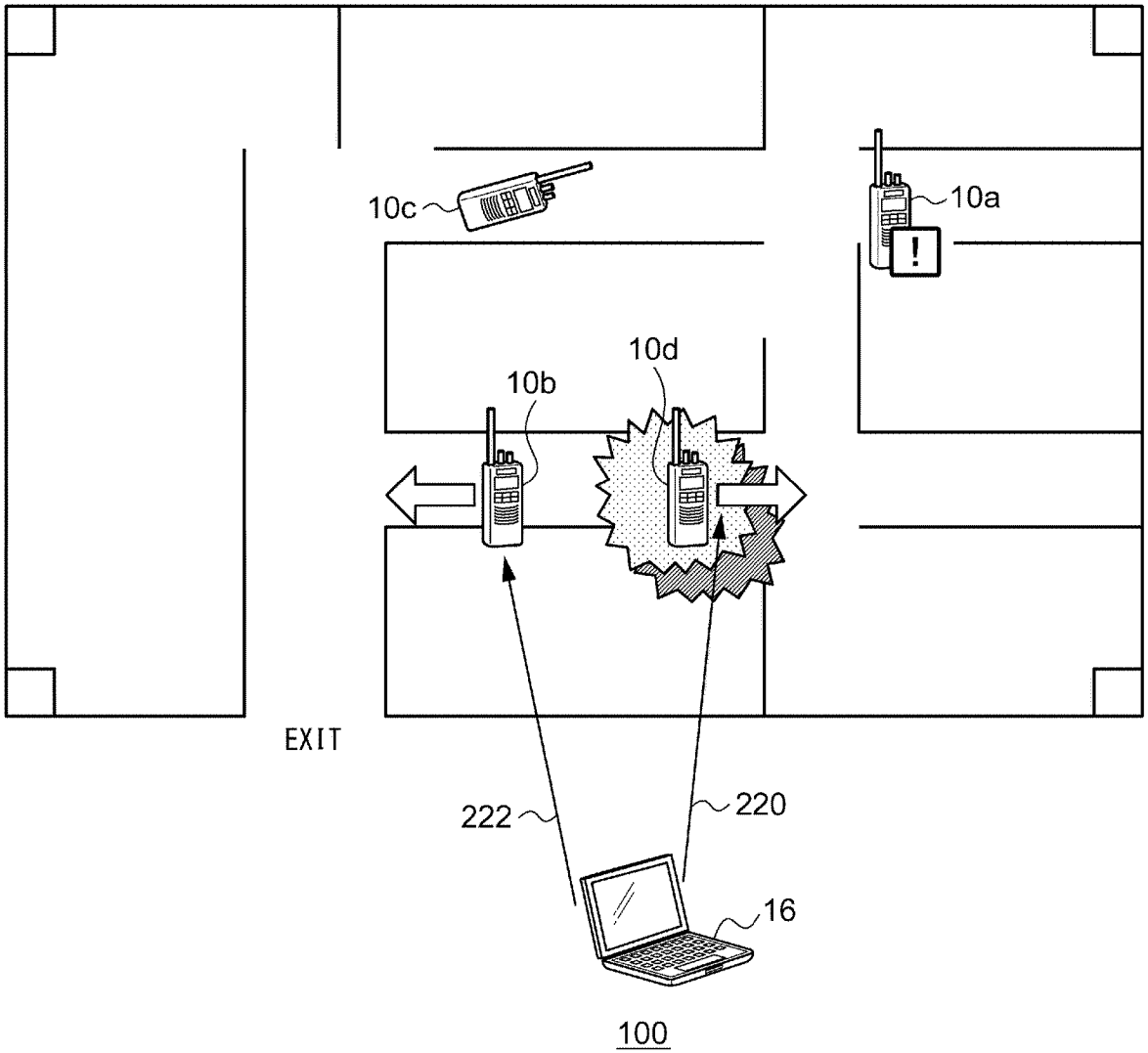
FIG. 6 is a diagram that shows a further arrangement of multiple wireless devices in the guide system shown in FIG. 1.

FIG. 6 shows a further arrangement of multiple wireless devices 10 in the guide system 100. In the situation shown in FIG. 4, the user having the second wireless device 10*b* and the user having the fourth wireless device 10*d* may possibly move. As a result, the order of the second wireless device 10*b* and the fourth wireless device 10*d* on the evacuation route may be changed. However, since the management device 16 continuously receives the position information of the second wireless device 10*b* and the position information of the fourth wireless device 10*d*, the management device 16 perceives the change of order of the second wireless device 10*b* and fourth wireless device 10*d*. Upon the perception, the management device 16 transmits the notification instruction 220 to the fourth wireless device 10*d* and transmits the stop instruction 222 to the second wireless device 10*b*.

Figure 7:
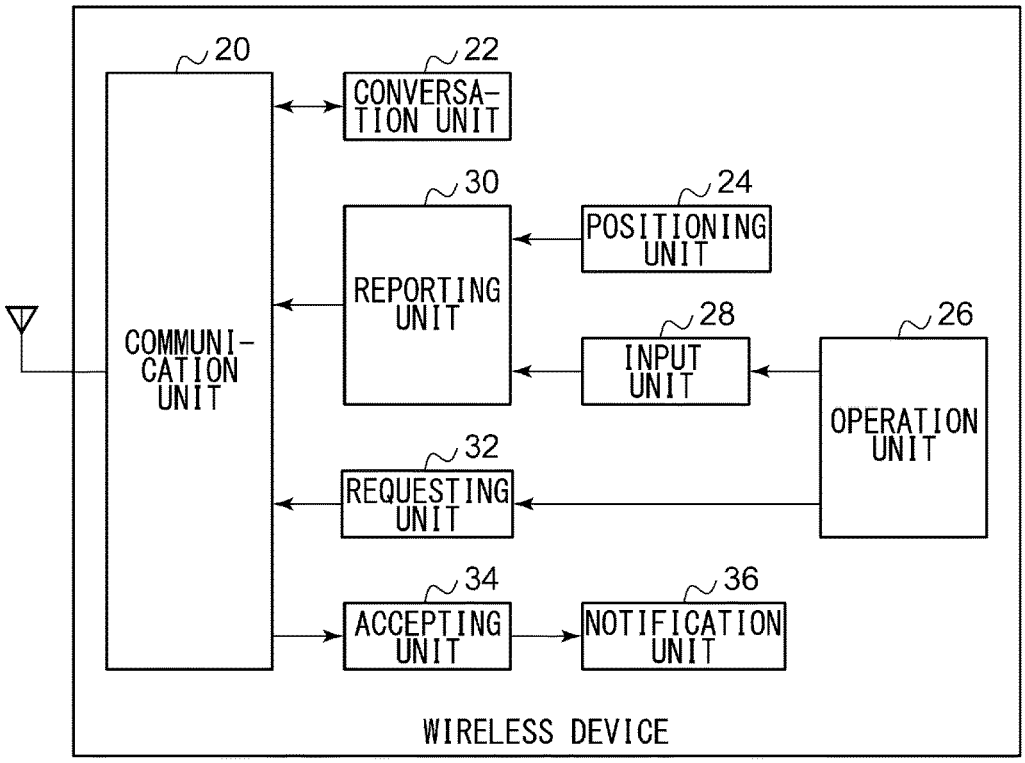
FIG. 7 is a diagram that shows a configuration of a wireless device shown in FIG. 1.

FIG. 7 shows a configuration of a wireless device 10. The wireless device 10 comprises a communication unit 20, a conversation unit 22, a positioning unit 24, an operation unit 26, an input unit 28, a reporting unit 30, a requesting unit 32, an accepting unit 34, and a notification unit 36. The communication unit 20 is available for the wireless communication system set forth above and communicates with the base station device 12, which is not illustrated. The communication unit 20 also communicates with the management device 16 via the base station device 12 and the network 14. The conversation unit 22 performs, via the communication unit 20, processing for conversation with another wireless device 10. Since a publicly-known technique may be used for the processing for conversation, a specific description thereof is omitted here.

The positioning unit 24 has a positioning function of a global positioning system (GPS) and measures the position of the wireless device 10. Position information acquired as a result of measurement is represented by latitude and longitude. The positioning unit 24 outputs position information to the reporting unit 30. The reporting unit 30 receives the position information from the positioning unit 24. The reporting unit 30 then reports the position information to the management device 16 via the communication unit 20.

The operation unit 26 is an interface for receiving a user's operation and may include buttons, for example. The operation unit 26 receives status information manually input by a user. FIG. 8 shows a table of status information input via the operation unit 26. As shown in FIG. 8, the table includes a status information column 300 and an identification information column 302. The status information column 300 contains the aforementioned five kinds of information. The identification information column 302 contains pieces of identification information corresponding to the respective pieces of status information. The operation unit 26 receives one of the pieces of identification information. The operation unit 26 then outputs the identification information to the input unit 28.

The input unit 28 receives identification information from the operation unit 26. This corresponds to receiving status information manually input by a user. The status information may also be automatically input by means of a sensor, instead of being manually input by a user. The input unit 28 outputs the status information to the reporting unit 30. The reporting unit 30 receives the status information from the input unit 28. The reporting unit 30 then reports the status information to the management device 16 via the communication unit 20. At the time, position information and status information may be reported together.

When the wireless device 10 is the request-side wireless device, the operation unit 26 receives a request from the user to the management device 16 for guidance to an evacuation route. The operation unit 26 then outputs the request to the requesting unit 32. The requesting unit 32 receives the request from the operation unit 26. Accordingly, the requesting unit 32 requests the management device 16 to perform guidance to an evacuation route by transmitting a request signal to the management device 16 via the communication unit 20.

When the wireless device 10 is a guide-side wireless device, i.e., when the requesting unit 32 thereof does not request guidance, the accepting unit 34 accepts a notification instruction from the management device 16 via the communication unit 20. This corresponds to accepting an instruction for guidance to an evacuation route. When the accepting unit 34 accepts a notification instruction, the notification unit 36 performs notification of an evacuation route. More specifically, the notification unit 36 outputs a beep or turns on an LED, as stated previously. The accepting unit 34 also accepts a stop instruction from the management device 16 via the communication unit 20. When the accepting unit 34 accepts a stop instruction, the notification unit 36 stops the notification.

The configuration described above may be implemented by a CPU or memory of any given computer, an LSI, or the like in terms of hardware, and by a memory-loaded program or the like in terms of software. In the present embodiment is shown a functional block configuration realized by cooperation thereof. Therefore, it would be understood by those skilled in the art that these functional blocks may be implemented in a variety of forms by hardware only, software only, or a combination thereof.

Figure 9:
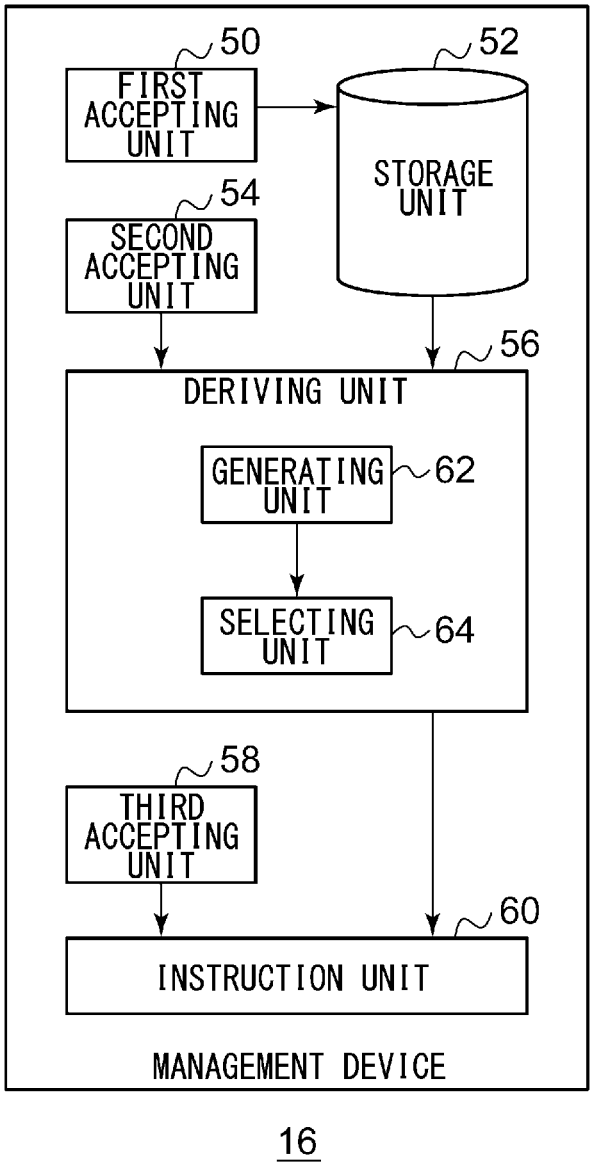
FIG. 9 is a diagram that shows a configuration of a management device shown in FIG. 1.

FIG. 9 shows a configuration of the management device 16. The management device 16 comprises a first accepting unit 50, a storage unit 52, a second accepting unit 54, a deriving unit 56, a third accepting unit 58, and an instruction unit 60, and the deriving unit 56 includes a generating unit 62 and a selecting unit 64.

The first accepting unit 50 accepts status information and position information from each of multiple wireless devices 10 via the network 14, which is not illustrated. At the time, the first accepting unit 50 may accept the status information and position information together or separately. To such information, device information for identifying the wireless device 10 as the transmission source is attached. The first accepting unit 50 outputs the status information and position information thus accepted to the storage unit 52. The storage unit 52 receives the status information and position information from the first accepting unit 50. Accordingly, the storage unit 52 stores the status information and position information for each wireless device 10 based on the device information.

The second accepting unit 54 accepts a request signal from at least one of the multiple wireless devices 10 via the network 14. This corresponds to accepting, from the request-side wireless device, a request for guidance to an evacuation route. Also to a request signal, device information for identifying the request-side wireless device is attached. Although in the following will be described the case where a request signal is provided by one of multiple wireless devices 10 in the interest of clarity, multiple request signals may be accepted. If multiple request signals are accepted, the request signals will be processed simultaneously in parallel where possible. Namely, with respect to each of the multiple request signals, a route candidate is generated, a route is selected, and notification is ordered. If request signals cannot be processed simultaneously in parallel, degrees of priority for the request signals will be calculated according to a predetermined method, and evacuation guidance processing will be performed for a request signal with the highest degree of priority. For example, the degree of priority for each of multiple wireless devices 10 may be determined in advance or may be calculated according to the distance from an exit so that a request signal from a wireless device 10 positioned farthest from the exit will be processed. The second accepting unit 54 outputs a request signal and device information to the generating unit 62.

Upon reception of a request signal and device information from the second accepting unit 54, the generating unit 62 acquires, from the storage unit 52, position information according to the device information. The generating unit 62 recognizes the arrangement of rooms and hallways within the building and generates multiple evacuation route candidates leading to the exit based on the acquired position information. Although in the following will be described processing for one candidate among multiple candidates in the interest of clarity, the same processing may be performed for other candidates. The selecting unit 64 retrieves from the storage unit 52 a wireless device 10 having position information included in a route candidate and acquires status information of the retrieved wireless device 10 from the storage unit 52.

FIG. 10 shows a table retained in the generating unit 62. As shown in FIG. 10, the table includes an identification information column 310 and a score column 312. As with in FIG. 8, a piece of information in the identification information column 310 corresponds to a piece of status information. The score column 312 contains scores for the respective pieces of identification information. The description will now return to FIG. 9. The generating unit 62 refers to the table shown in FIG. 8 so as to convert pieces of status information of wireless devices 10 included in the route candidate into scores and summate the converted scores. The generating unit 62 also divides the summation by the number of wireless devices 10 included in the route candidate so as to derive a score average value of the route candidate.

According to the tables shown in FIGS. 8 and 10, when the status information "fire spreading" or "collapse of ceiling or wall" is included, the score average value becomes larger. On the other hand, when the status information "safe" is included largely, the score average value becomes smaller. Namely, the score average value of a route candidate through which a user can easily pass is smaller, and that of a route candidate through which a user cannot easily pass is larger. The generating unit 62 outputs, to the selecting unit 64, information regarding multiple generated candidates and the score average values of the respective candidates. The information regarding a candidate includes information regarding the route and information regarding wireless devices 10 on the route. The score of each candidate may be calculated in consideration of static route information, such as the distance to the exit, the width of the passage, and the height of the ceiling. For example, when two routes have the same score based on the status information, the score of each of the routes may be calculated so as to be smaller when the distance to the exit is shorter, to be smaller when the width of the passage is wider, and to be smaller when the height of the ceiling is higher. Such calculation of the score enables safer evacuation guidance.

The selecting unit 64 receives, from the generating unit 62, information regarding multiple candidates and the score average values of the respective candidates. The selecting unit 64 then compares the score average values of the respective candidates and selects the candidate with the smallest score average value as the evacuation route. This corresponds to selecting, as the evacuation route, one of multiple evacuation route candidates generated by the generating unit 62, in consideration of status information for each of the multiple evacuation route candidates. As a result, a wireless device 10 included in the selected evacuation route corresponds to the guide-side wireless device mentioned previously. For example, multiple wireless devices 10 are included in the evacuation route. In this way, when the second accepting unit 54 accepts a request signal, the deriving unit 56 including the generating unit 62 and the selecting unit 64 derives an evacuation route based on the status information and position information accepted by the first accepting unit 50. The selecting unit 64 outputs information regarding the selected evacuation route to the selecting unit 64.

The instruction unit 60 receives the information regarding the evacuation route from the selecting unit 64. The instruction unit 60 extracts multiple wireless devices 10 included in the information regarding the evacuation route and arranges the multiple wireless devices 10 included in the evacuation route in the direction from the position of the request-side wireless device toward the exit. The instruction unit 60 then selects, from among the multiple wireless devices 10, the wireless device 10 closest to the request-side wireless device. Accordingly, the instruction unit 60 transmits a notification instruction to the selected wireless device 10 via the network 14.

After the notification instruction is transmitted, the third accepting unit 58 periodically accepts position information from the request-side wireless device via the network 14. The third accepting unit 58 outputs the position information to the instruction unit 60. The instruction unit 60 receives the position information from the third accepting unit 58. The instruction unit 60 then compares the position information from the third accepting unit 58 with the position information of the selected wireless device 10. When the request-side wireless device gets within a predetermined range of the selected wireless device 10, the instruction unit 60 transmits a stop instruction to the selected wireless device 10 via the network 14. The predetermined range may be set to one meter, for example. After the transmission of the stop instruction, the instruction unit 60 selects the next wireless device 10 along the evacuation route. The next wireless device 10 along the evacuation route is a wireless device 10 arranged next to the previously-selected wireless device 10 on the exit side. Accordingly, the instruction unit 60 transmits a notification instruction to the next wireless device 10 thus selected via the network 14.

The third accepting unit 58 and the instruction unit 60 repeat the above processing, so that a notification instruction is transmitted to each of the remaining wireless devices 10 arranged along the evacuation route in turn. Thus, the instruction unit 60 instructs wireless devices 10 arranged along the evacuation route derived by the deriving unit 56 to perform guidance to the evacuation route.

Figure 11:
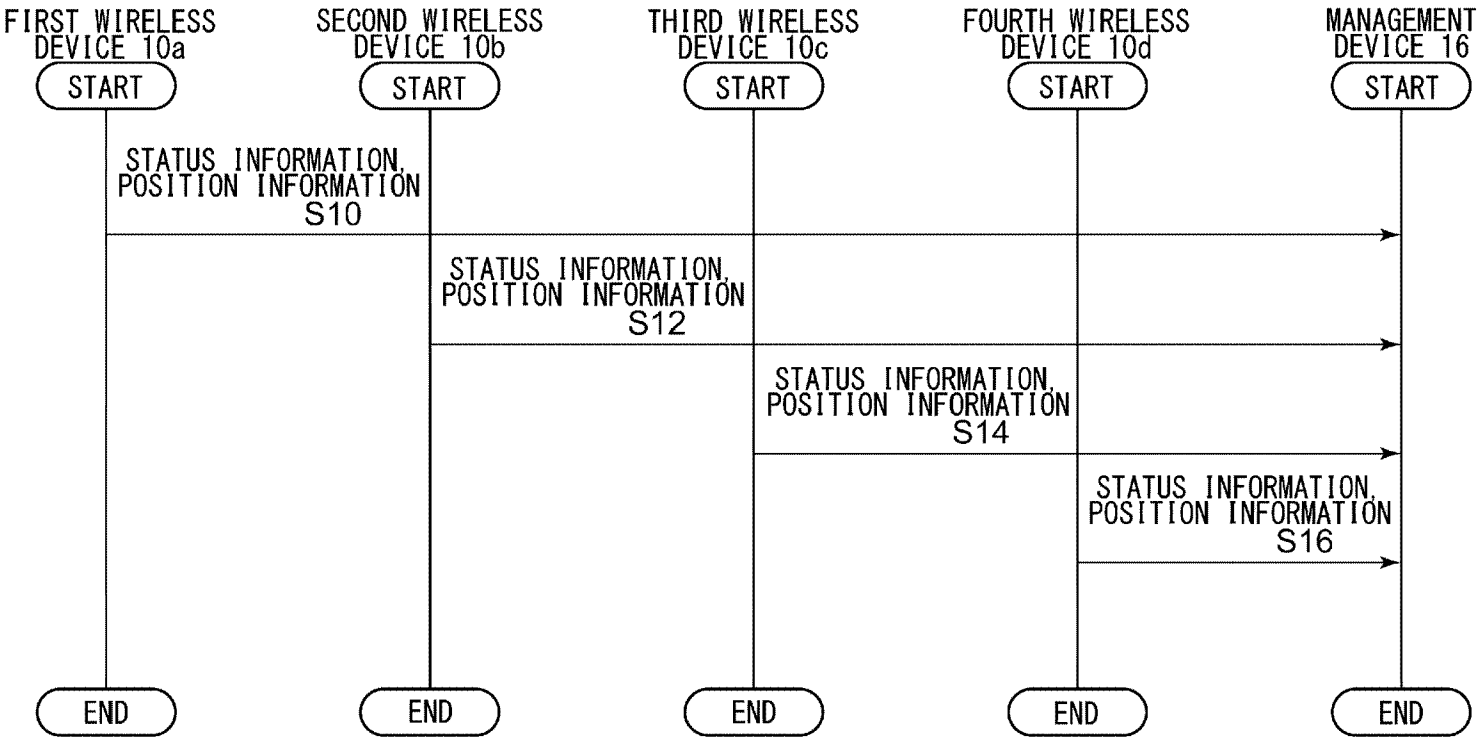
FIG. 11 is a sequential diagram that shows a report procedure performed by the guide system shown in FIG. 1.

There will now be described an operation performed by the guide system 100 having the configuration set forth above. FIG. 11 is a sequential diagram that shows a report procedure performed by the guide system 100. The first wireless device 10*a* transmits status information and position information to the management device 16 (S10). The second wireless device 10*b* transmits status information and position information to the management device 16 (S12). The third wireless device 10*c* transmits status information and position information to the management device 16 (S14). The fourth wireless device 10*d* transmits status information and position information to the management device 16 (S16).

Figure 12:
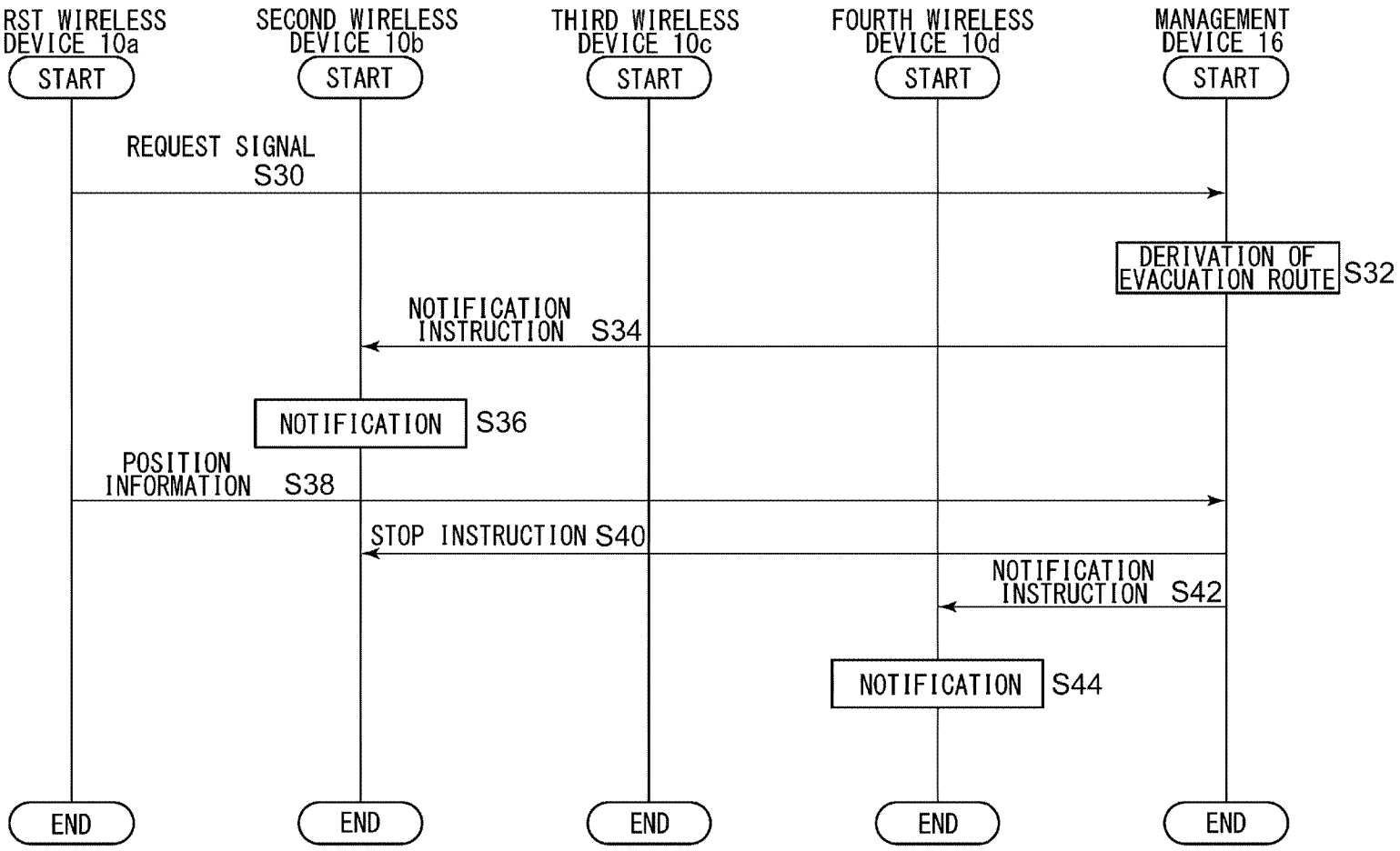
FIG. 12 is a sequential diagram that shows a notification procedure performed by the guide system shown in FIG. 1.

FIG. 12 is a sequential diagram that shows a notification procedure performed by the guide system 100. The first wireless device 10*a* transmits a request signal to the management device 16 (S30). The management device 16 derives an evacuation route (S32). The management device 16 then transmits a notification instruction to the second wireless device 10*b* (S34). Accordingly, the second wireless device 10*b* performs notification (S36). The first wireless device 10*a* transmits position information to the management device 16 (S38). The management device 16 transmits a stop instruction to the second wireless device 10*b* (S40) and then transmits a notification instruction to the fourth wireless device 10*d* (S42). Accordingly, the fourth wireless device 10*d* performs notification (S44).

Figure 13:
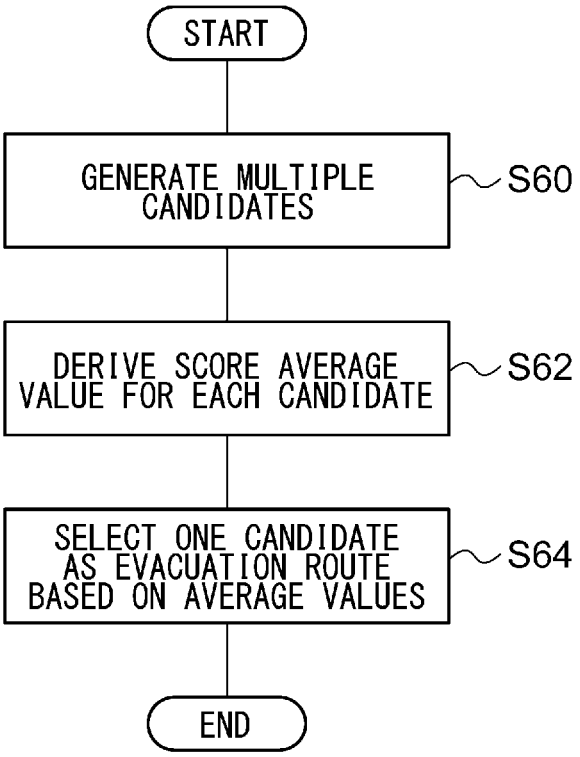
FIG. 13 is a flowchart that shows a procedure for deriving an evacuation route performed by the management device shown in FIG. 8.

FIG. 13 is a flowchart that shows a procedure for deriving an evacuation route performed by the management device 16. The generating unit 62 generates multiple candidates (S60). The generating unit 62 then derives a score average value of each candidate (S62). Based on the average values, the selecting unit 64 selects one candidate as the evacuation route (S64).

According to the present embodiment, since a wireless device: (1) requests guidance to an evacuation route; or (2) accepts an instruction for guidance to an evacuation route, while reporting status information and position information, a wireless device possessed by a user can be used on both the request side and the guide side. Since a wireless device possessed by a user can be used on both the request side and the guide side, increase in facilities can be prevented. Also, since a wireless device possessed by a user can be used on both the request side and the guide side, guidance to an evacuation route is enabled. Further, since wireless devices normally used for conversation or the like are used for guidance to an evacuation route, guidance to an evacuation route can be performed while increase in facilities is prevented.

Since a wireless device receives status information manually input by a user, status information selected at the user's discretion can be used. Also, since a wireless device also receives status information automatically input by means of a sensor, the user's convenience can be improved. A wireless device performs notification of an evacuation route upon reception of an instruction from the management device, thereby performing guidance to the evacuation route. Since status information and position information is used, an evacuation route according to the surrounding environment of the wireless device can be derived. Further, since one of multiple evacuation route candidates is selected as the evacuation route in consideration of status information for each of the multiple evacuation route candidates, the evacuation route can be easily derived.

Since multiple freely-movable wireless devices perform route guidance in cooperation with each other, no device needs to be placed in advance. Since no device needs to be placed in advance, the system can also be used in an urgent situation. Also, since guidance to an evacuation route is performed based on pieces of position information and status information of multiple wireless devices, a dangerous route can be avoided. Further, since guidance is intuitively performed using sound or light, the system can be used in various situations.

Second Embodiment

Next, the second embodiment will be described. As with the first embodiment, the second embodiment also relates to a guide system that guides a user having a wireless device to an evacuation route. The management device in the first embodiment derives an evacuation route and instructs multiple guide-side wireless devices arranged on the evacuation route in turn to perform notification. The management device in the second embodiment also derives an evacuation route and instructs the first guide-side wireless device arranged on the evacuation route to perform notification, but does not instruct the remaining guide-side wireless devices to perform notification. In the second embodiment, the first guide-side wireless device transmits a signal to the next guide-side wireless device, and, upon reception of the signal, the next guide-side wireless device performs notification. Thereafter, the next guide-side wireless device transmits a signal to the subsequent guide-side wireless device, and, upon reception of the signal, the subsequent guide-side wireless device performs notification. Namely, the multiple guide-side wireless devices arranged on the evacuation route serially transfer a signal. The guide system 100 according to the second embodiment is of a similar type to the guide system 100 shown in FIG. 1. Accordingly, a description will be given mainly of the differences from the first embodiment.

Figure 14:
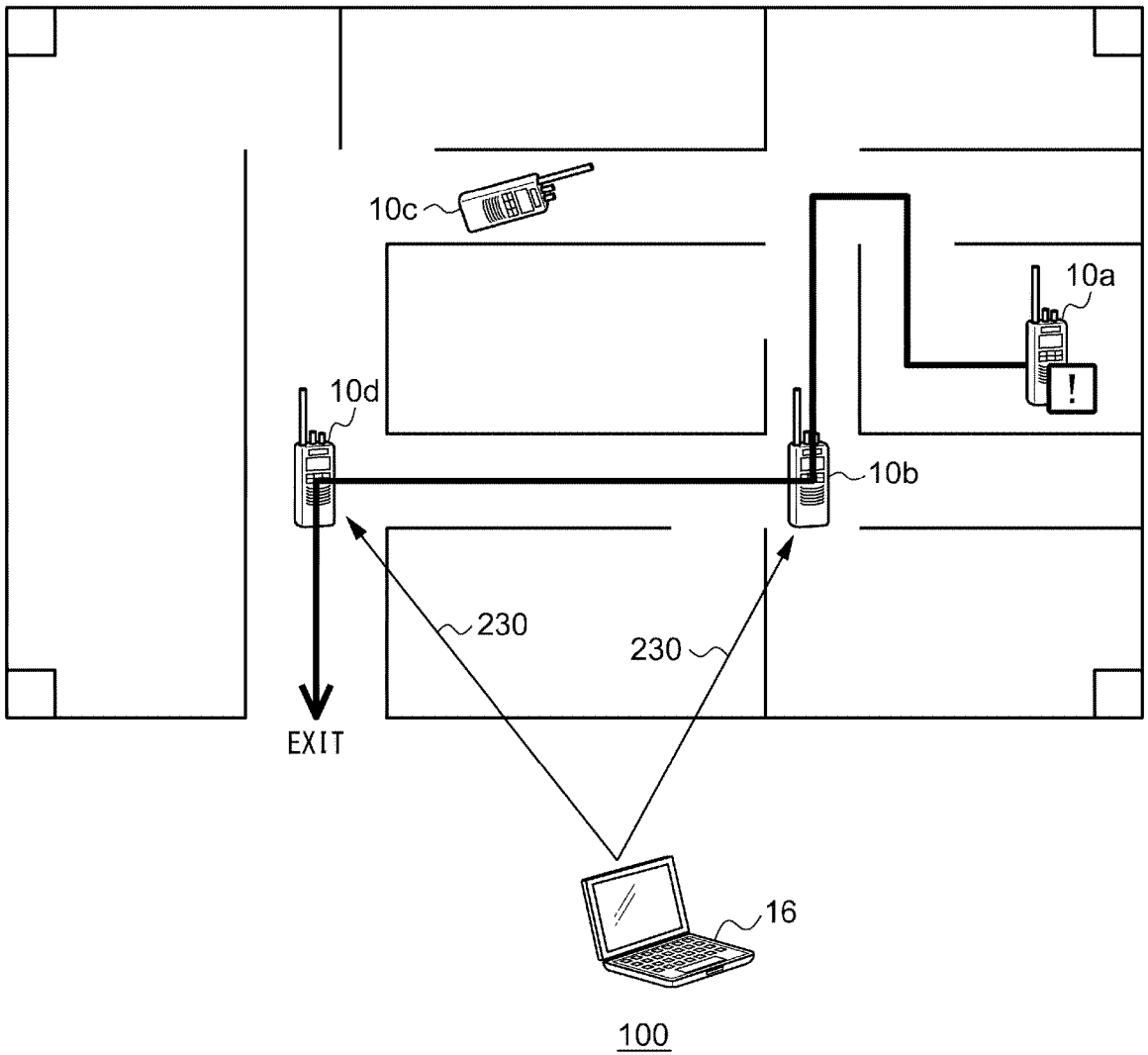
FIG. 14 is a diagram that shows an arrangement of multiple wireless devices in a guide system according to a second embodiment.

In the following, before the configurations of the wireless devices 10 and management device 16 are described, processing of guidance to an evacuation route performed by the guide system 100 will be specifically described with reference to FIGS. 14-16. Since the processing performed by the management device 16 to derive an evacuation route is the same as described in the first embodiment, the explanation thereof is omitted here. FIG. 14 shows an arrangement of multiple wireless devices 10 in the guide system 100 according to the second embodiment. The first wireless device 10*a* corresponds to the request-side wireless device mentioned previously and transmits a request signal to the management device 16. Upon reception of the request signal from the first wireless device 10*a*, the management device 16 derives an evacuation route from the position where the first wireless device 10*a* is located to the exit. In this case, an evacuation route including the second wireless device 10*b* and the fourth wireless device 10*d* is derived. The management device 16 transmits, to each of the second wireless device 10*b* and fourth wireless device 10*d*, a notification instruction 230 indicating that the second wireless device 10*b* and fourth wireless device 10*d* are included in the evacuation route in this order. Each of the second wireless device 10*b* and fourth wireless device 10*d* receives the notification instruction 230.

Figure 15:
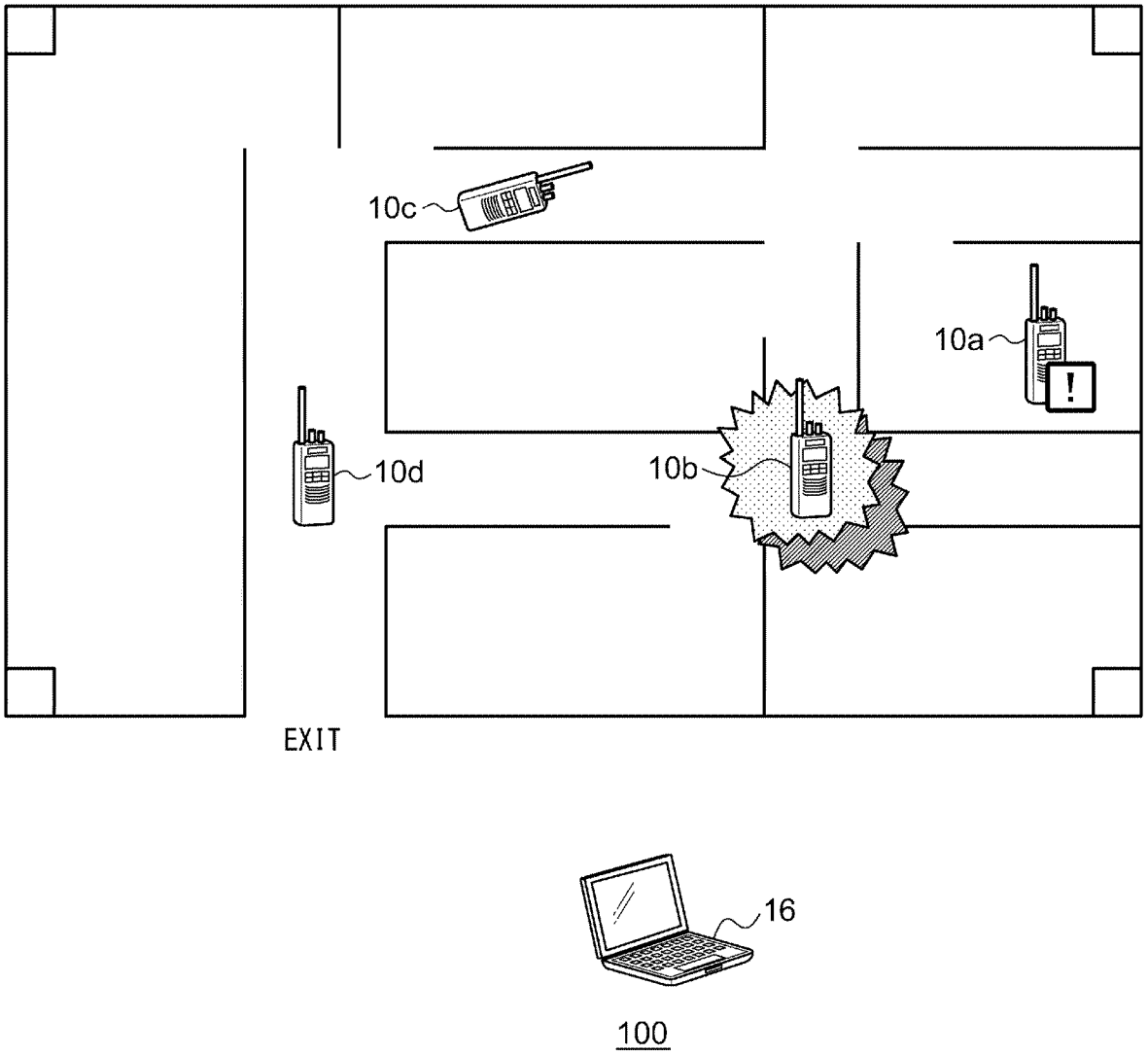
FIG. 15 is a diagram that shows another arrangement of multiple wireless devices in the guide system according to the second embodiment.

FIG. 15 shows another arrangement of multiple wireless devices 10 in the guide system 100 according to the second embodiment. By receiving the notification instruction 230, the second wireless device 10*b* and fourth wireless device 10*d* recognize that the second wireless device 10*b* and fourth wireless device 10*d* are arranged in this order on the evacuation route. Since the second wireless device 10*b* is arranged first on the evacuation route, the second wireless device 10*b* outputs a beep or turns on an LED to visually or aurally notify a person around the second wireless device 10*b* of the position of the second wireless device 10*b*. According to the sound or light provided by the second wireless device 10*b*, the user having the first wireless device 10*a* recognizes the direction to head in. Based on the recognized direction, the user moves toward the second wireless device 10*b*. In the meantime, the first wireless device 10*a* continues to regularly transmit position information. The second wireless device 10*b* receives position information from the first wireless device 10*a*.

Figure 16:
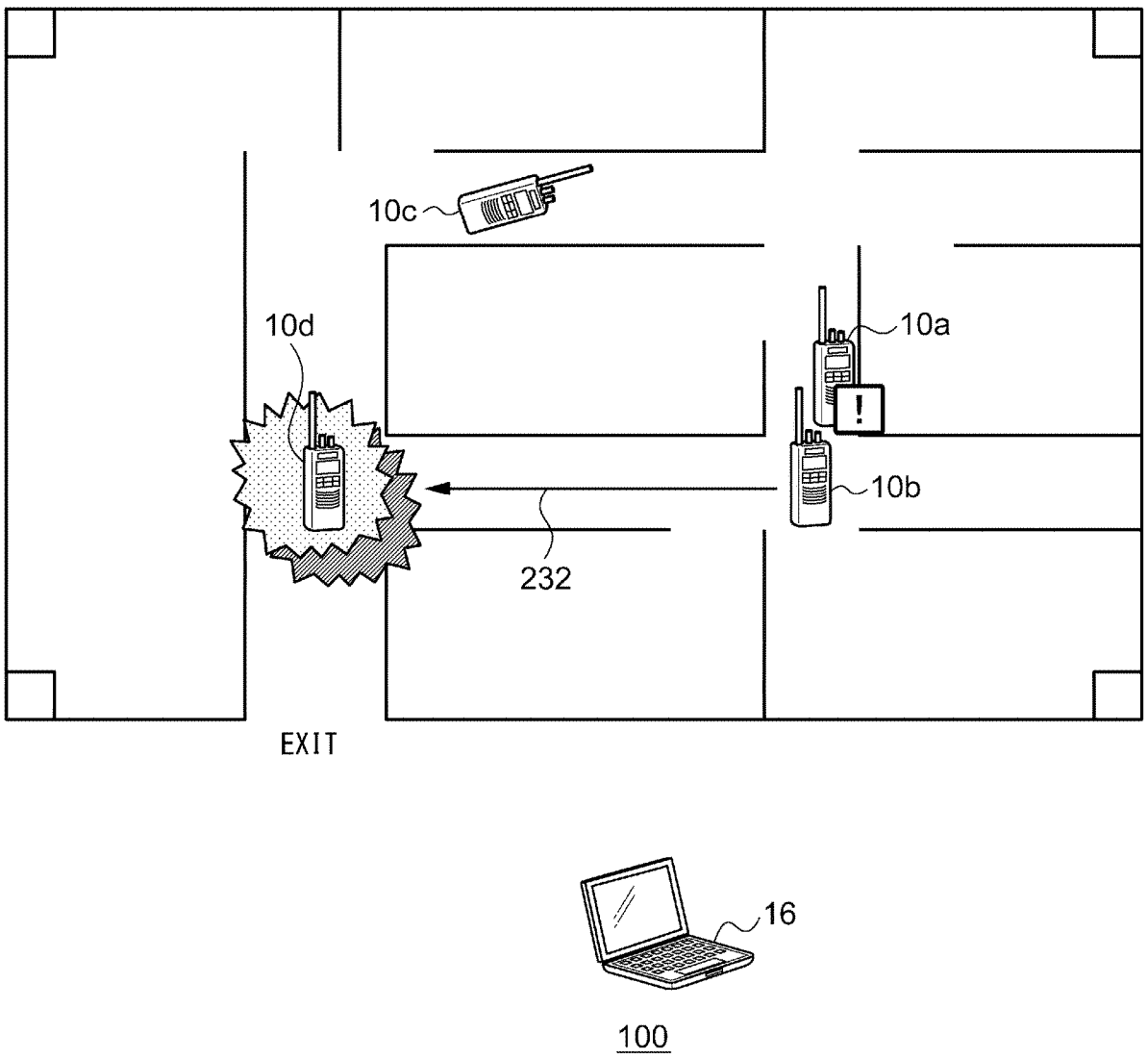
FIG. 16 is a diagram that shows yet another arrangement of multiple wireless devices in the guide system according to the second embodiment.

FIG. 16 shows yet another arrangement of multiple wireless devices 10 in the guide system 100 according to the second embodiment. Based on the position information of the first wireless device 10*a* and the position information of the second wireless device 10*b*, the second wireless device 10*b* perceives that the first wireless device 10*a* got closer to the second wireless device 10*b*, such as that the first wireless device 10*a* got within one meter of the second wireless device 10*b*. Upon the perception, the second wireless device 10*b* transmits a signal 232 to the fourth wireless device 10*d*, which is the next wireless device 10 on the evacuation route, and stops the notification. Upon reception of the signal 232, the fourth wireless device 10*d* outputs a beep or turns on an LED to visually or aurally notify a person around the fourth wireless device 10*d* of the position of the fourth wireless device 10*d*. According to the sound or light provided by the fourth wireless device 10*d*, the user having the first wireless device 10*a* recognizes the direction to head in. There is no wireless device 10 subsequent to the fourth wireless device 10*d* on this evacuation route; however, if there is a subsequent wireless device 10, the abovementioned processing will be repeated so as to guide the user having the first wireless device 10*a* to the exit.

Figure 17:
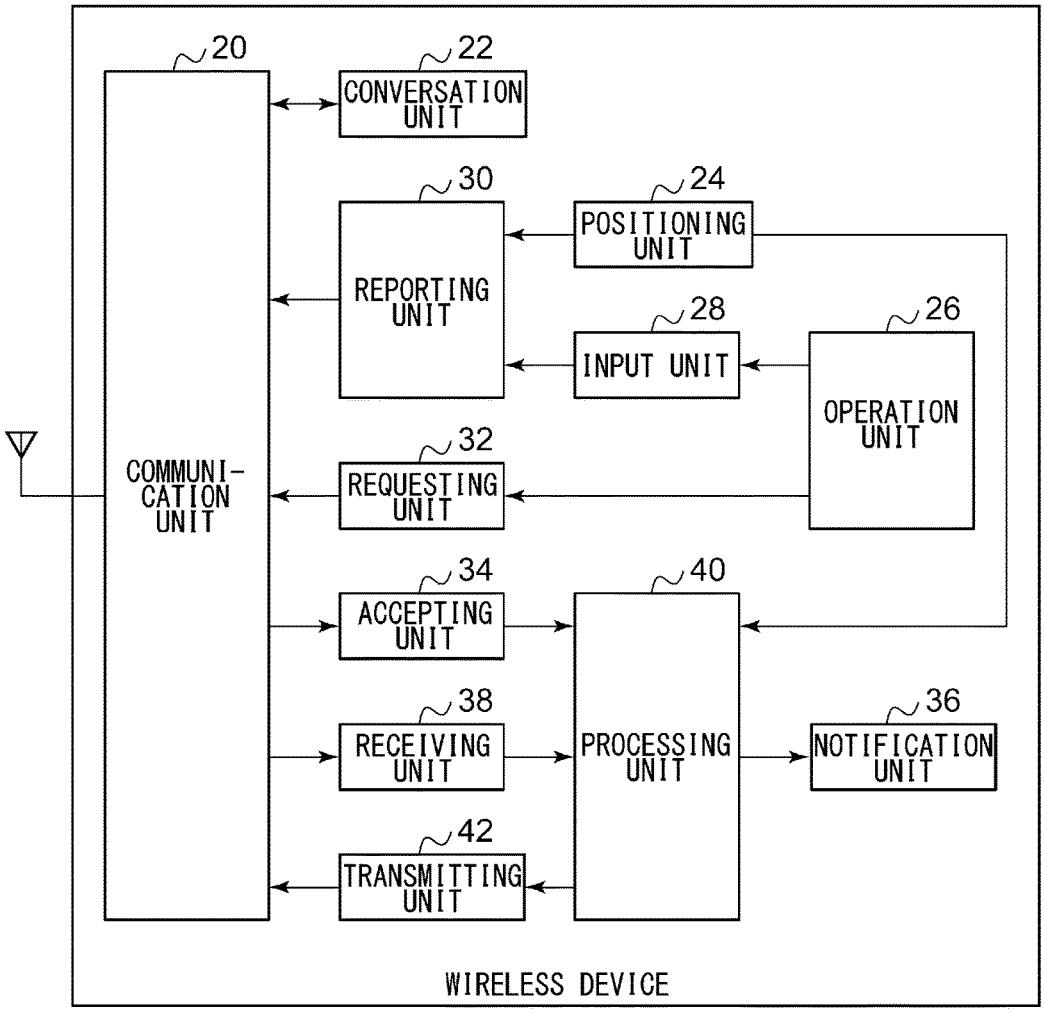
FIG. 17 is a diagram that shows a configuration of a wireless device according to the second embodiment.

FIG. 17 shows a configuration of a wireless device 10 according to the second embodiment. The wireless device 10 comprises the communication unit 20, the conversation unit 22, the positioning unit 24, the operation unit 26, the input unit 28, the reporting unit 30, the requesting unit 32, the accepting unit 34, the notification unit 36, a receiving unit 38, a processing unit 40, and a transmitting unit 42.

When the wireless device 10 is a guide-side wireless device, i.e., when the requesting unit 32 thereof does not request guidance, the accepting unit 34 accepts a notification instruction from the management device 16 via the communication unit 20. The notification instruction is different from that of the first embodiment and indicates the order of wireless devices 10 included in the evacuation route. This can be said to be information regarding multiple wireless devices 10 sequentially arranged along the evacuation route. The accepting unit 34 outputs, to the processing unit 40, the information regarding the order of wireless devices 10 included in the evacuation route.

The processing unit 40 receives from the accepting unit 34 the information regarding the order of wireless devices 10 included in the evacuation route. Based on the information, the processing unit 40 recognizes another wireless device 10 preceding the subject wireless device 10 and also recognizes yet another wireless device 10 subsequent to the subject wireless device 10.

The receiving unit 38 receives a signal from the another wireless device 10 preceding the subject wireless device 10 via the communication unit 20. The receiving unit 38 then notifies the processing unit 40 of the reception of the signal. When the receiving unit 38 receives the signal, the processing unit 40 allows the notification unit 36 to perform notification. According to the instruction from the processing unit 40, the notification unit 36 performs notification of the evacuation route. The notification is performed by outputting a beep or turning on an LED, as stated previously. When the information accepted by the accepting unit 34 indicates that the subject wireless device 10 is arranged first among multiple wireless devices 10 included in the evacuation route, the processing unit 40 allows the notification unit 36 to perform notification. In this case, reception of a signal by the receiving unit 38 is unnecessary.

The receiving unit 38 receives position information from the request-side wireless device via the communication unit 20. The receiving unit 38 then outputs the position information provided by the request-side wireless device to the processing unit 40. The processing unit 40 receives the position information of the request-side wireless device from the receiving unit 38 and also receives the position information of the subject wireless device 10 from the positioning unit 24. The processing unit 40 then compares the position information of the request-side wireless device with the position information of the subject wireless device 10. When the request-side wireless device gets within a predetermined range of the subject wireless device 10, the processing unit 40 allows the notification unit 36 to stop the notification. The predetermined range may be set to one meter, for example. Further, the processing unit 40 instructs the transmitting unit 42 to transmit a signal. The transmission destination of the signal is the yet another wireless device 10 subsequent to the subject wireless device 10.

Upon reception of the instruction from the processing unit 40, the transmitting unit 42 transmits a signal to the yet another wireless device 10 subsequent to the subject wireless device 10 via the communication unit 20. Namely, the transmitting unit 42 transmits a signal upon notification by the notification unit 36. When the information accepted by the accepting unit 34 indicates that the subject wireless device 10 is arranged last among multiple wireless devices 10 included in the evacuation route, the processing unit 40 does not allow the transmitting unit 42 to transmit the signal.

Figure 18:
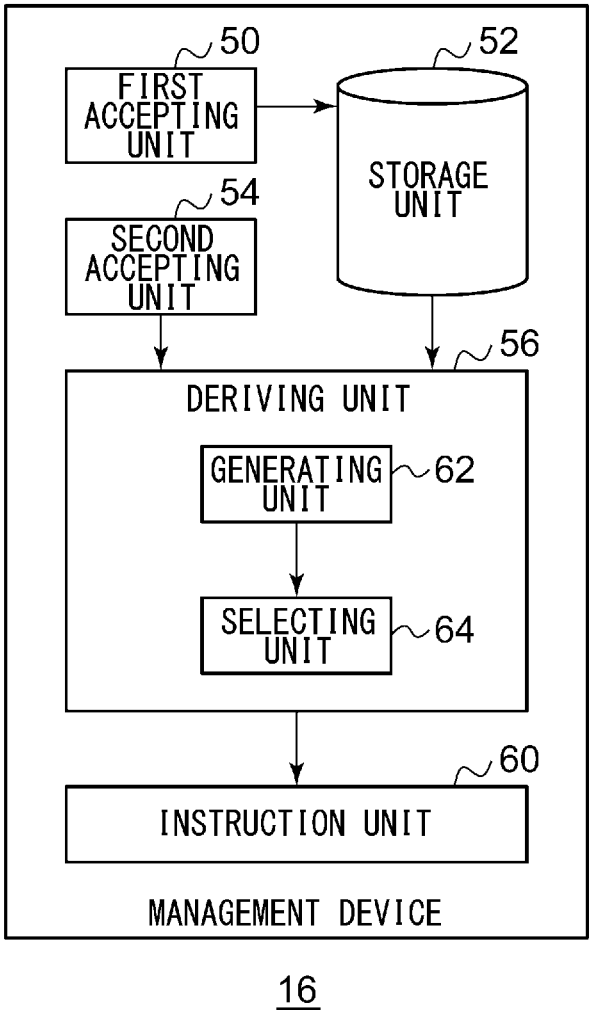
FIG. 18 is a diagram that shows a configuration of a management device according to the second embodiment.

FIG. 18 shows a configuration of the management device 16 according to the second embodiment. The management device 16 comprises the first accepting unit 50, the storage unit 52, the second accepting unit 54, the deriving unit 56, and the instruction unit 60, and the deriving unit 56 includes the generating unit 62 and the selecting unit 64.

The instruction unit 60 receives information regarding an evacuation route from the selecting unit 64. The instruction unit 60 then transmits the information regarding the evacuation route to each of multiple wireless devices 10 included in the information regarding the evacuation route via the network 14.

Figure 19:
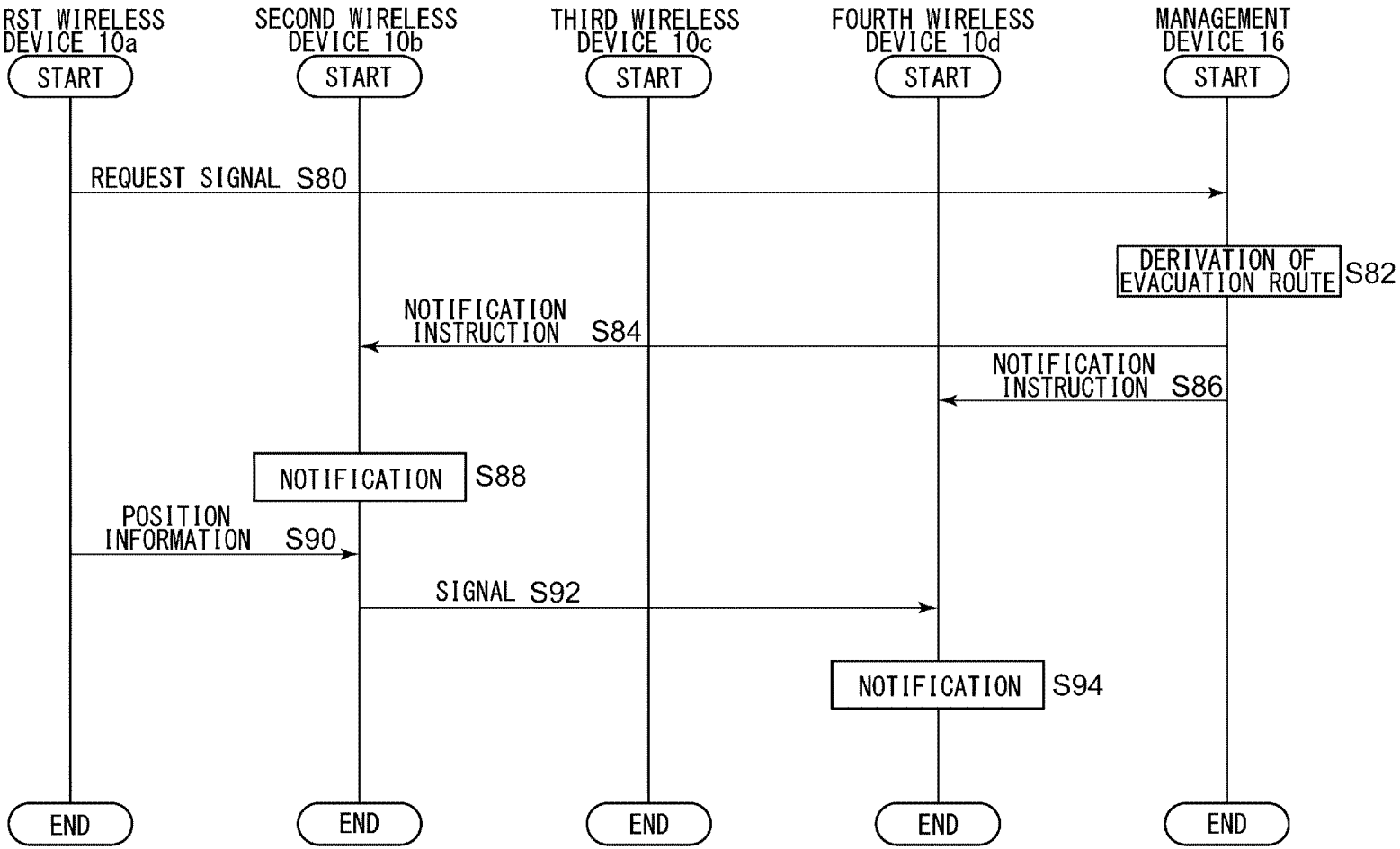
FIG. 19 is a sequential diagram that shows a notification procedure performed by the guide system according to the second embodiment.

FIG. 19 is a sequential diagram that shows a notification procedure performed by the guide system 100 according to the second embodiment. The first wireless device 10*a* transmits a request signal to the management device 16 (S80). The management device 16 derives an evacuation route (S82). The management device 16 transmits a notification instruction to the second wireless device 10*b* (S84) and also transmits a notification instruction to the fourth wireless device 10*d* (S86). The second wireless device 10*b* performs notification (S88). The first wireless device 10*a* transmits position information to the second wireless device 10*b* (S90). The second wireless device 10*b* transmits a signal to the fourth wireless device 10*d* (S92). Accordingly, the fourth wireless device 10*d* performs notification (S94).

According to the present embodiment, a signal is transferred between guide-side wireless devices, so that guidance to an evacuation route is enabled even if communication with the management device becomes impossible. Also, since the management device only gives an instruction as to a guide route at the beginning, the processing amount of the management device can be reduced.

The present invention has been described with reference to the embodiments. The embodiments are intended to be illustrative only, and it will be obvious to those skilled in the art that various modifications to a combination of constituting elements or processes could be developed and that such modifications also fall within the scope of the present invention.

According to the first and second embodiments, the notification unit 36 outputs a beep or turns on an LED. However, the operations are not limited thereto, and the notification unit 36 may change at least one of output sound and color of emitted light, according to the distance from the destination of an evacuation route. There will now be described the modification.

(1) Each wireless device 10 may output a different sound according to the distance from the exit. For example, the sound output from a wireless device 10 closer to the exit may be set to higher pitch, such as "Do" for the second wireless device 10*b* and "Mi" for the fourth wireless device 10*d*. Also, the pitch of each sound is set so that each of the sounds output from multiple wireless devices 10 can be easily recognized even when the sounds are mixed.

(2) Each wireless device 10 may output light of a different color according to the distance from the exit. For example, the color of light emitted by a wireless device 10 closer to the exit may be set to a color closer to "blue," which has a safe image, such as "yellow" for the second wireless device 10*b* and "blue" for the fourth wireless device 10*d*.

(3) Instead of allowing, after the request-side wireless device gets closer to a guide-side wireless device, the next guide-side wireless device to emit sound or light, wireless devices 10 may be made to serially emit sound or light in the order of the wireless device 10 farthest from the exit, the wireless device 10 second farthest from the exit, the wireless device 10 third farthest from the exit, . . . , and the wireless device 10 closest to the exit, when the evacuation guidance is started. Conversely, the wireless devices 10 may be made to serially emit sound or light in the order of the wireless device 10 closest to the exit, the wireless device 10 second closest to the exit, . . . , and the wireless device 10 farthest from the exit. Namely, the order (timing) of reporting (emitting sound or light) may be determined according to the distance from the exit. Accordingly, a user can easily sense the direction toward the exit in advance. Also, users at the site can understand their positions each other and the number of the users. According to the present modification, since at least one of output sound and color of emitted light is changed, the evacuation route can be easily recognized.

What is claimed is:

1. A management device, comprising:

a CPU; and a memory storing executable instructions that, in response to execution by the CPU, causes the management device to perform operations comprising:

accepting, from each of a plurality of wireless devices, status information regarding a surrounding environment of the wireless device and position information of the wireless device;

accepting a request for guidance to an evacuation route from a requesting wireless device that is at least one of the plurality of wireless devices;

deriving, when the request is received, the evacuation route on the basis of the status information and the position information accepted; and transmitting, to a wireless device arranged along the derived evacuation route that is other than the requesting wireless device, a notification instruction for at least one of:

visually notifying a person around the wireless device of a position of the wireless device by using light emission from a light emitting device, the light emitting device being provided in the wireless device, or aurally notifying the person around the wireless device of the position of the wireless device by using an output of sound from a speaker, the speaker being provided in the wireless device, wherein the wireless device to which the notification instruction is transmitted is determined in accordance with a position of the requesting wireless device.

2. The management device according to claim 1, wherein a plurality of wireless devices other than the requesting wireless device are arranged along the evacuation route, a stop instruction to stop giving the notification is transmitted to the wireless device that has begun giving the notification in response to the notification instruction, and, subsequently, the notification instruction is transmitted to another wireless device preventing two or more wireless devices from giving the notification concurrently.

3. The management device according to claim 1, wherein a first wireless device closest to the position of the requesting wireless device is identified from among wireless devices arranged along the evacuation route that is other than the requesting wireless device, and the notification instruction is transmitted first to the identified first wireless device.

4. The management device according to claim 3, wherein the stop instruction to stop giving the notification is transmitted to the first wireless device when a distance between the requesting wireless device and the first wireless device is equal to or less than a predetermined value.

5. The management device according to claim 4, wherein the stop instruction to stop giving the notification is transmitted to the first wireless device when a distance between the requesting wireless device and the first wireless device is equal to or less than a predetermined value, and from among the wireless devices arranged along the evacuation route, a wireless device located nearer to a destination of the evacuation route than the first wireless device and closest to the first wireless device is identified as a second wireless device, and the notification instruction is transmitted second to the second wireless device.

6. The management device according to claim 1, wherein the status information reported is information indicating a degree of danger around the respective wireless devices, and scores numerically representing the status information of the plurality of wireless devices is calculated and the evacuation route is derived based on the scores.

7. The management device according to claim 6, wherein scores having an increasingly larger value with increasing danger around the wireless device are used, a summation of the scores for each route candidate is calculated, and the evacuation route is derived based on the summation.

8. The management device according to claim 7, wherein an average value of scores is calculated for each route candidate by dividing the summation of the scores for each route candidate by a number of wireless devices arranged in the route candidate, and the route candidate with the smallest average value of the scores is selected as the evacuation route.

9. The management device according to claim 6, wherein the evacuation route is derived based on, in addition to the scores, at least one of a distance from the position of the requesting wireless device to a destination of the evacuation route, a width of a passage of the evacuation route, and a height of a ceiling of the evacuation route.

10. The management device according to claim 1, wherein when requests for guidance to the evacuation route are received from a plurality of requesting wireless devices, the requesting wireless device farthest from a destination of the evacuation route is identified from among the plurality of requesting wireless devices, and the evacuation route for the identified requesting wireless device is derived.

11. A non-transitory computer-readable memory medium storing a computer program comprising:

accepting, from each of a plurality of wireless devices, status information regarding a surrounding environment of the wireless device and position information of the wireless device;

accepting a request for guidance to an evacuation route from a requesting wireless device that is at least one of the plurality of wireless devices;

deriving, when the request is received, the evacuation route on the basis of the status information and the position information accepted; and transmitting, to a wireless device arranged along the derived evacuation route that is other than the requesting wireless device, a notification instruction for at least one of:

visually notifying a person around the wireless device of a position of the wireless device by using light emission from a light emitting device, the light emitting device being provided in the wireless device, or aurally notifying the person around the wireless device of the position of the wireless device by using an output of sound from a speaker, the speaker being provided in the wireless device, wherein the wireless device to which the notification instruction is transmitted is determined in accordance with a position of the requesting wireless device.

12. A wireless device comprising:

a CPU; and a memory storing executable instructions that, in response to execution by the CPU, causes the wireless device to perform operations comprising:

reporting, to a management device, status information regarding a surrounding environment of the wireless device and position information of the wireless device;

requesting the management device to perform guidance to an evacuation route when a predetermined operation is input to an operation unit;

when the wireless device does not request guidance to an evacuation route, accepting, from the management device, a notification instruction to start giving a notification of the guidance to the evacuation route selected based on a plurality of status information items and a plurality of position information items reported from the wireless device, defined as a host wireless device, and from another wireless device, and accepting a stop instruction to stop the notification of the guidance to the evacuation route after accepting the notification instruction;

upon reception of the notification instruction, at least one of:

visually notifying a person around the host wireless device of a position of the host wireless device by using light emission from a light emitting device, or aurally notifying the person around the host wireless device of the position of the host wireless device by using an output of sound from a speaker;

stopping the notification when the stop instruction is received;

receiving position information of a requesting wireless device that requests the management device for guidance to the evacuation route;

detecting a distance between the position of the requesting wireless device and the position of the host wireless device;

transmitting a control signal for visually or aurally notifying a person around another wireless device other than the host wireless device and the requesting wireless device of the position of the another wireless device, to the another wireless device, wherein the accepted notification instruction includes information related to an order assigned to each of a plurality of wireless devices located on the evacuation route in an ascending order of distances from the requesting wireless device, the notification is stopped when the distance detected is equal to or less than a predetermined value, and when the distance detected is equal to or less than the predetermined value, the wireless device next in the order to the host wireless device is identified as the another wireless device in accordance with the information related to the order included in the notification instruction, and the control signal is transmitted to the another wireless device.

13. A wireless device comprising:

a CPU; and a memory storing executable instructions that, in response to execution by the CPU, causes the wireless device to perform operations comprising:

reporting, to a management device, status information regarding a surrounding environment of the wireless device and position information of the wireless device;

requesting the management device to perform guidance to an evacuation route when a predetermined operation is input to an operation unit;

when the wireless device does not request guidance to an evacuation route, accepting, from the management device, a notification instruction to start giving a notification of the guidance to the evacuation route selected based on a plurality of status information items and a plurality of position information items reported from the wireless device, defined as a host wireless device, and from another wireless device, and accepting a stop instruction to stop the notification of the guidance to the evacuation route after accepting the notification instruction;

upon reception of the notification instruction, at least one of:

visually notifying a person around the host wireless device of a position of the host wireless device by using light emission from a light emitting device, or aurally notifying the person around the host wireless device of the position of the host wireless device by using an output of sound from a speaker; and stopping the notification when the stop instruction is received, wherein a smaller a distance from the position of the host wireless device to a destination of the evacuation route, a higher a pitch of output sound is.

14. The wireless device according to claim 13, wherein the status information reported is information indicating a degree of danger around the host wireless device, and the evacuation route relevant to the notification instruction is a route selected based on scores numerically representing the status information reported from a plurality of wireless devices.

15. The wireless device according to claim 14, wherein the evacuation route relevant to the notification instruction accepted is a route selected by using scores having an increasingly larger value with increasing danger and using a condition that requires the smallest average value of the scores of the wireless devices located on the route.

16. The wireless device according to claim 14, wherein the evacuation route relevant to the notification instruction accepted is a route selected based on, in addition to the scores, at least one of a distance from the position of the wireless device requesting the management device for guidance to the evacuation route to a destination of the evacuation route, a width of a passage of the evacuation route, and a height of a ceiling of the evacuation route.

17. The wireless device according to claim 13, wherein the light emitting device emits light closer to a blue color in proportion to a decreasing distance from the position of the host wireless device to a destination of the evacuation route.

* * * * *